US005823550A

United States Patent [19]

Bennett et al.

[11] Patent Number: 5,823,550

[45] Date of Patent: Oct. 20, 1998

[54] PORTABLE CASE FOR TRADE SHOW MATERIALS

[75] Inventors: Joel S. Bennett; Robert G. McRorie, III, both of Greensboro, N.C.

[73] Assignee: Laarhoven Design, Inc., Norcross, Ga.

[21] Appl. No.: 562,908

[22] Filed: Nov. 27, 1995

[51] Int. Cl.[6] ..... B62B 1/00; B62B 3/14

[52] U.S. Cl. ..... 280/47.26; 286/47.34; 286/33.998

[58] Field of Search ..... 280/47.33, 79.2, 280/33.998, 47, 26, 30, 47.34, 37; 206/509, 505, 511, 512, 503; 220/671, 675, 23.2

[56] References Cited

U.S. PATENT DOCUMENTS

| | | | |
|---|---|---|---|
| 3,701,079 | 10/1972 | Bowden et al. | 339/36 |
| 3,987,829 | 10/1976 | Leone | 150/5 |
| 4,071,258 | 1/1978 | Wallace | 280/79.2 |
| 4,575,109 | 3/1986 | Cowdery | 280/37 |
| 4,874,088 | 10/1989 | Leben | 206/387 |
| 5,099,968 | 3/1992 | Kikuchi | 190/108 |
| 5,203,452 | 4/1993 | Small et al. | 206/329 |
| 5,259,215 | 11/1993 | Rocca | 62/371 |
| 5,271,515 | 12/1993 | Berkheimer et al. | 220/4.27 |
| 5,313,817 | 5/1994 | Meinders | 62/457.1 |
| 5,316,096 | 5/1994 | Good | 180/19.1 |
| 5,351,793 | 10/1994 | Gibbs | 190/115 |
| 5,373,708 | 12/1994 | Dumoulin, Jr. | 62/457.7 |
| 5,415,333 | 5/1995 | Wills | 224/328 |
| 5,435,423 | 7/1995 | Rekuc et al. | 190/18 A |
| 5,445,397 | 8/1995 | Evans | 280/47.18 |
| 5,464,115 | 11/1995 | Tisbo et al. | 220/324 |
| 5,480,191 | 1/1996 | Litin et al. | 280/831 |
| 5,503,275 | 4/1996 | Fesquet | 206/505 |
| 5,520,400 | 5/1996 | Hung | 280/47.26 |
| 5,528,453 | 6/1996 | Berman et al. | 361/625 |
| 5,533,667 | 7/1996 | Gale | 229/120.01 |
| 5,551,562 | 9/1996 | Beretta | 206/317 |
| 5,568,848 | 10/1996 | Liang | 190/18 A |
| 5,588,569 | 12/1996 | Mitomi et al. | 224/153 |

*Primary Examiner*—Brian L. Johnson
*Assistant Examiner*—Bridget Avery
*Attorney, Agent, or Firm*—Rhodes, Coats & Bennett, L.L.P.

[57] ABSTRACT

A case for transporting exhibits and other materials includes a container having a bottom, two opposing sides, two opposing ends, and an open top. A wheel assembly is mounted at a first end of the container adjacent the bottom. First and second handles are disposed at respective ends of the container adjacent the open top. The first and second handles allow the container to be carried by two persons lifting on the first and second handles. A third handle is disposed at the end of the container opposite the wheel assembly and adjacent the bottom of the container. The third handle allows the container to be moved by lifting on the third handle and rolling the container on the wheel assembly. Integrally molded hand holds are also formed in the sides of the container adjacent the open top. To facilitate stacking of the containers, a pair of stacking feet project outwardly from one side of the container. The stacking feet mate with stacking holes formed in an opposing side of an adjacent container when the containers are stacked one upon another.

19 Claims, 22 Drawing Sheets

PORTABLE CASE FOR TRADE SHOW MATERIALS

FIELD OF THE INVENTION

The present invention relates generally to portable cases for transporting materials, and more particularly, to a portable case for containing, storing, and transporting trade show exhibits and materials.

BACKGROUND OF THE INVENTION

Cases for transporting exhibits and other materials for use at trade shows are known. Such cases typically comprise a molded plastic container of generally rectangular configuration. Such containers typically have a wheel assembly at one end and a handle at an opposing end to allow a person to move the container by rolling it on the wheel assembly.

The prior art containers known to applicant have one or more drawbacks. For example, many prior art containers are provided with only a few handles, and sometimes only a single handle. As a result, the handling of the container may be cumbersome in some situations. Another problem with some prior art cases is that they often employ a clam shell design in which two halves separate from one another to gain access to the contents of the container. This type of container must be laid flat on the floor before separating the halves to avoid spilling the contents of the container. This requires persons using the container to bend over to remove the contents of the container, or to lift the container.

Accordingly, there is a need for a more ergonomically designed container which permits easy handling of the container in a variety of contexts, and which minimizes the need for bending to remove the contents of the container.

SUMMARY AND OBJECTS OF THE INVENTION

The present invention relates to an ergonomically designed case for containing, storing, and transporting trade show exhibits and materials. The case comprises a generally rectangular container having a bottom, two opposing sides, two opposing ends, and an open top. A lid fits into the open top of the container to secure the contents of the container. The lid is secured by buckles, straps, or other suitable means.

A wheel assembly is disposed at one end of the container adjacent the bottom thereof. The container can be rotated about the wheel assembly from a normal loading and unloading position in which the container rests on its bottom, and an upright position in which the container rests on one end. First and second handles are disposed at opposite ends of the container adjacent the open top thereof. The first and second handles enable two persons to carry the container by lifting on the first and second handles. The second handle also enables a person to lift the front end of the container and pivot the container on the wheel assembly. A third handle is disposed adjacent the bottom of the container on the end opposite the wheel assembly. The third handle allows a single person to move the container by lifting on the third handle and rolling the container on the wheel assembly. The third handle is also used for rotating the container between the normal loading and unloading position, and the upright position.

In another aspect of the invention, hand holds are formed in the sides of the container adjacent the open top thereof. In a preferred embodiment of the invention, the hand holds are formed between ribs that extend vertically along the sides of the container. These ribs add strength and rigidity to the walls of the container. The integrally formed hand holds provide additional ways for lifting the container. For example, a single person can lift and carry the case by standing along one side of the case, reaching over the top of the case, and grasping a hand hold on the opposite side of the case.

In yet another aspect of the present invention, a pair of stacking feet project outwardly from one side of the case. Stacking recesses are formed in the opposite side of the case. The stacking feet and stacking recesses allow a plurality of cases to be laid on their side and stacked one upon another. When the cases are stacked in this manner, the stacking feet in one side of the case mate with stacking recesses in an adjacent case thereby preventing the cases from shifting during transportation. This feature also allows the cases to be conveniently stacked for storage. Also, the cases can be strapped together and rolled simultaneously.

Based on the foregoing, it is a primary object of the present invention to provide an ergonomically designed case for transporting trade show materials which permits easy handling of the case in a variety contexts, and which minimizes the need for bending to remove the contents of the case or to lift the case.

Another object of the present invention is to provide an ergonomically designed case which can be lifted and carried in a variety of ways by one or more persons.

Still another object of the present invention is to provide an ergonomically designed case which is durable construction and which will prevent damage to the contents of the case.

Still another object of the present invention is to provide an ergonomically designed case for transporting trade show exhibits which can be stacked on top of one another for shipment or storage.

Still another object of the invention is to provide an ergonomically designed case which can be strapped together with other cases of like design.

DETAILED DESCRIPTION OF THE INVENTION

Figure 1:
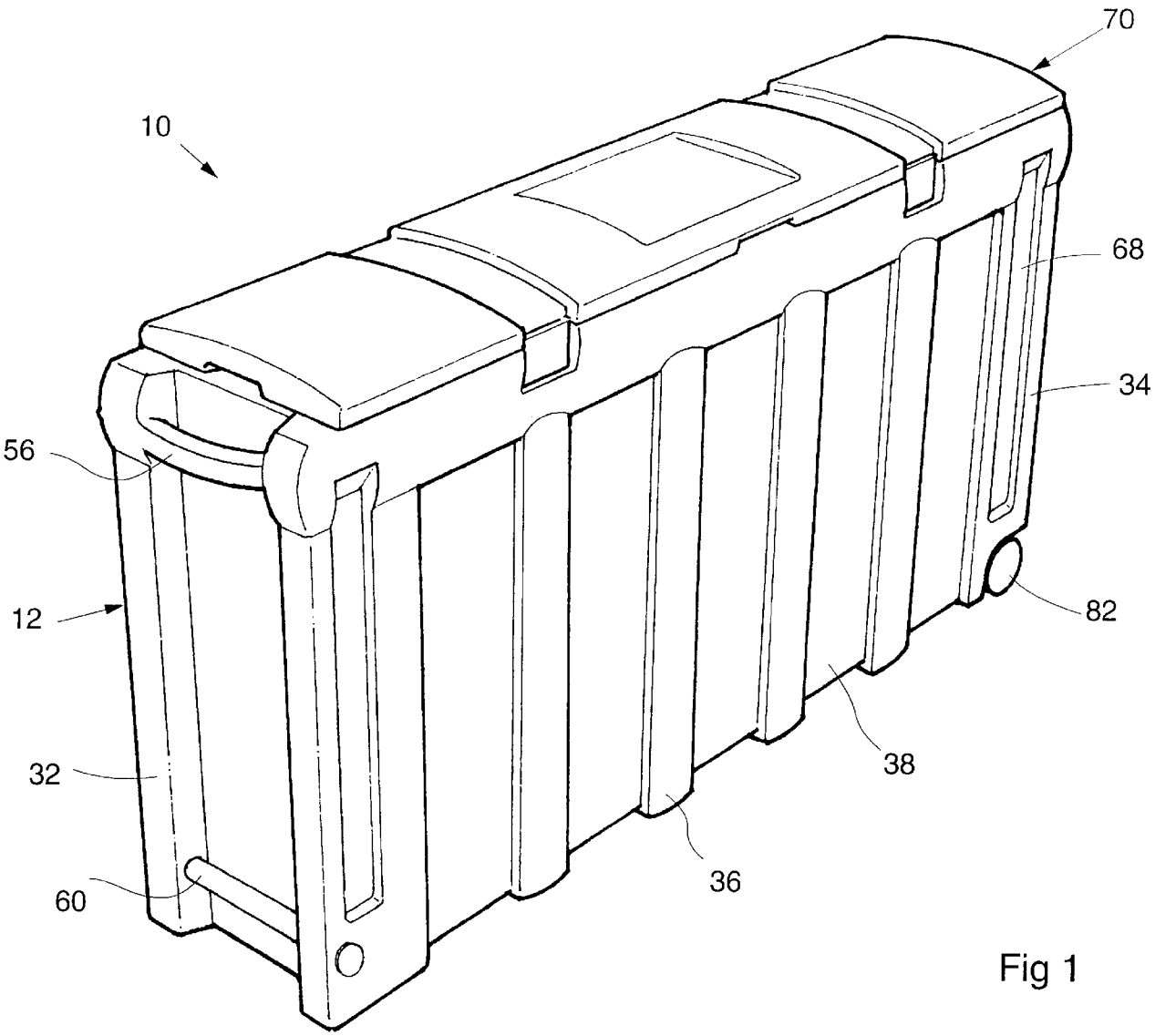
FIG. 1 is a perspective view of the portable case of the present invention from the front thereof.
Figure 2:
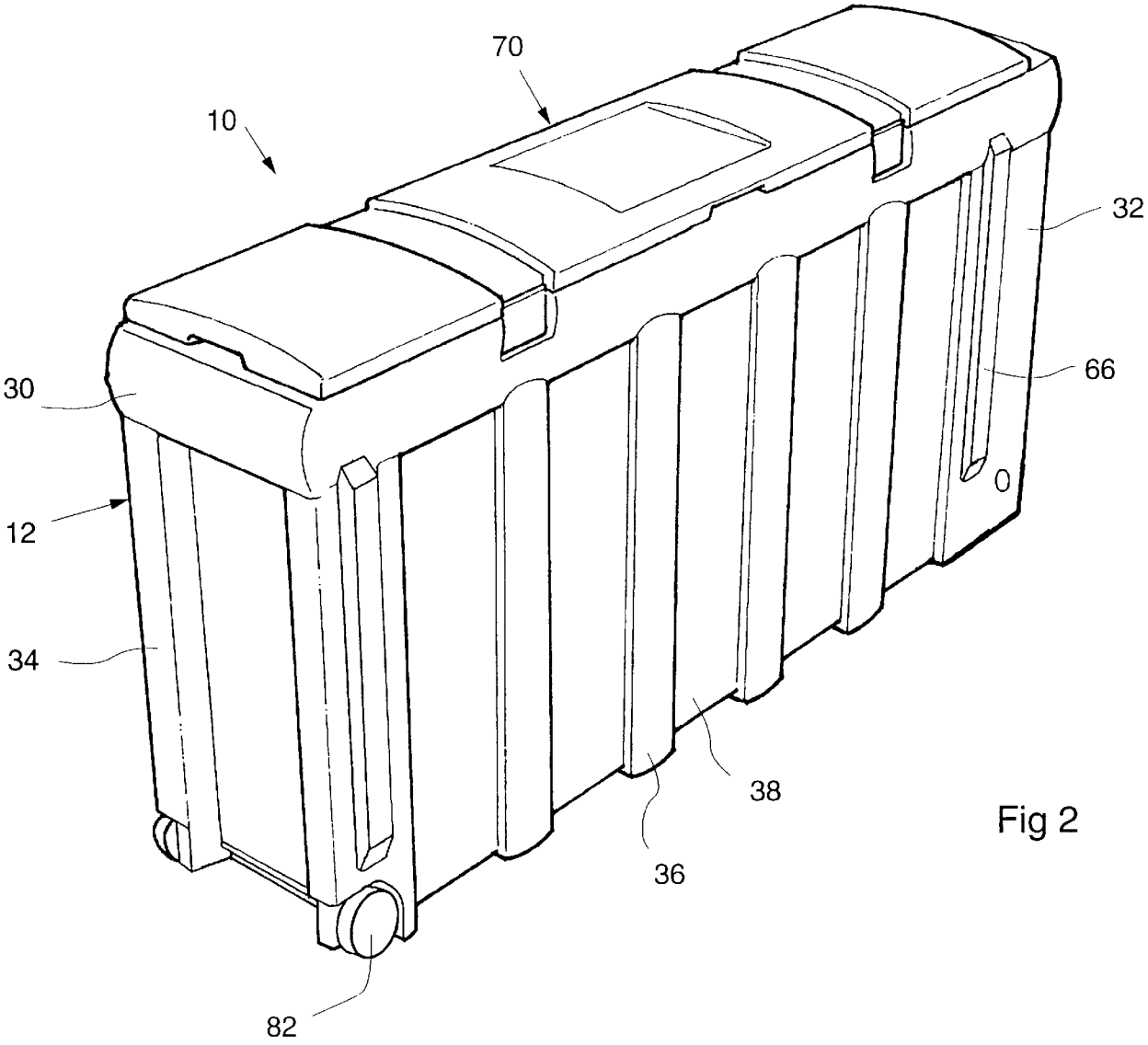
FIG. 2 is a perspective view of the portable case from the rear.

Referring now to the drawings, the portable case of the present invention is shown therein and indicated generally by the numeral 10. The case 10 comprises a generally rectangular container 12 for containing and storing trade show exhibits and other materials, and a lid 70 which is removably fastened to the container 12. The container 12 and lid 70 are preferably molded from a plastic material, such as a high-density polyethylene.

Figure 3:
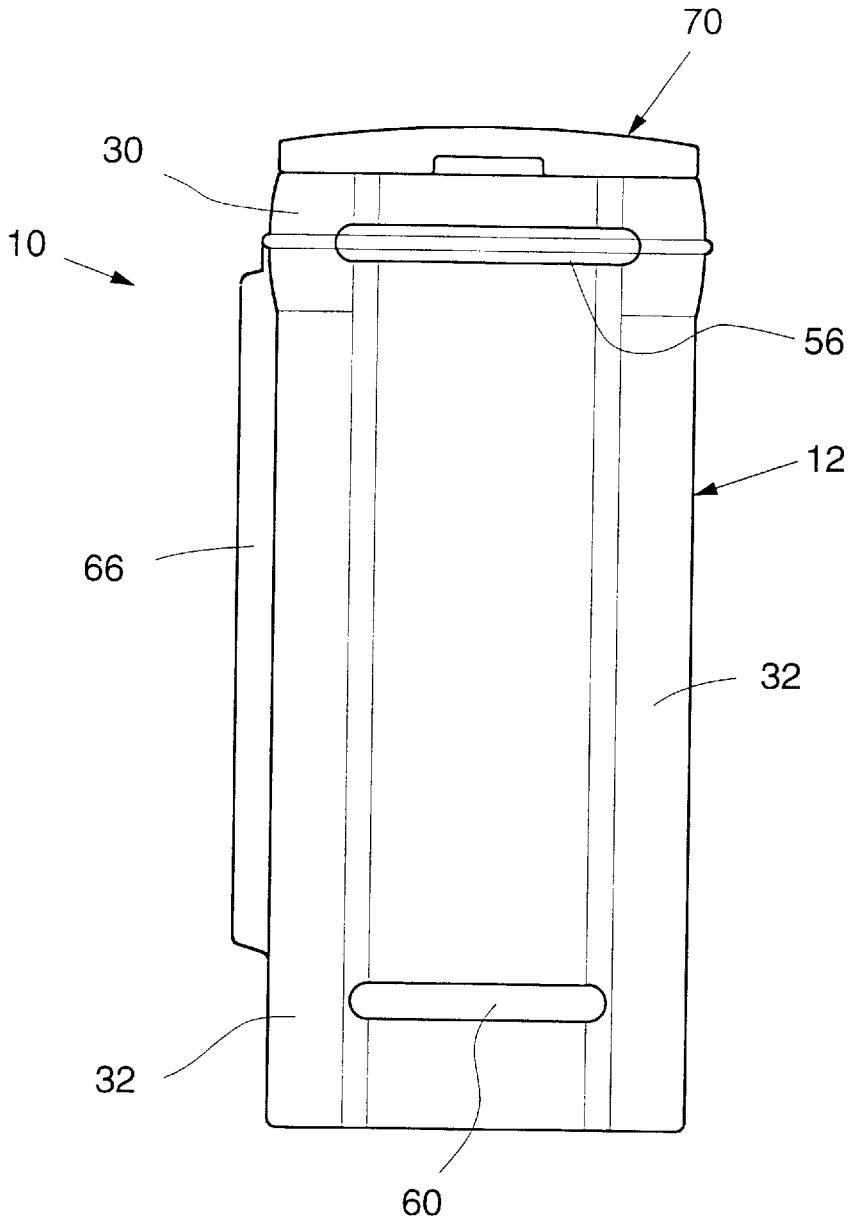
FIG. 3 is a front elevation view of the portable case.
Figure 4:
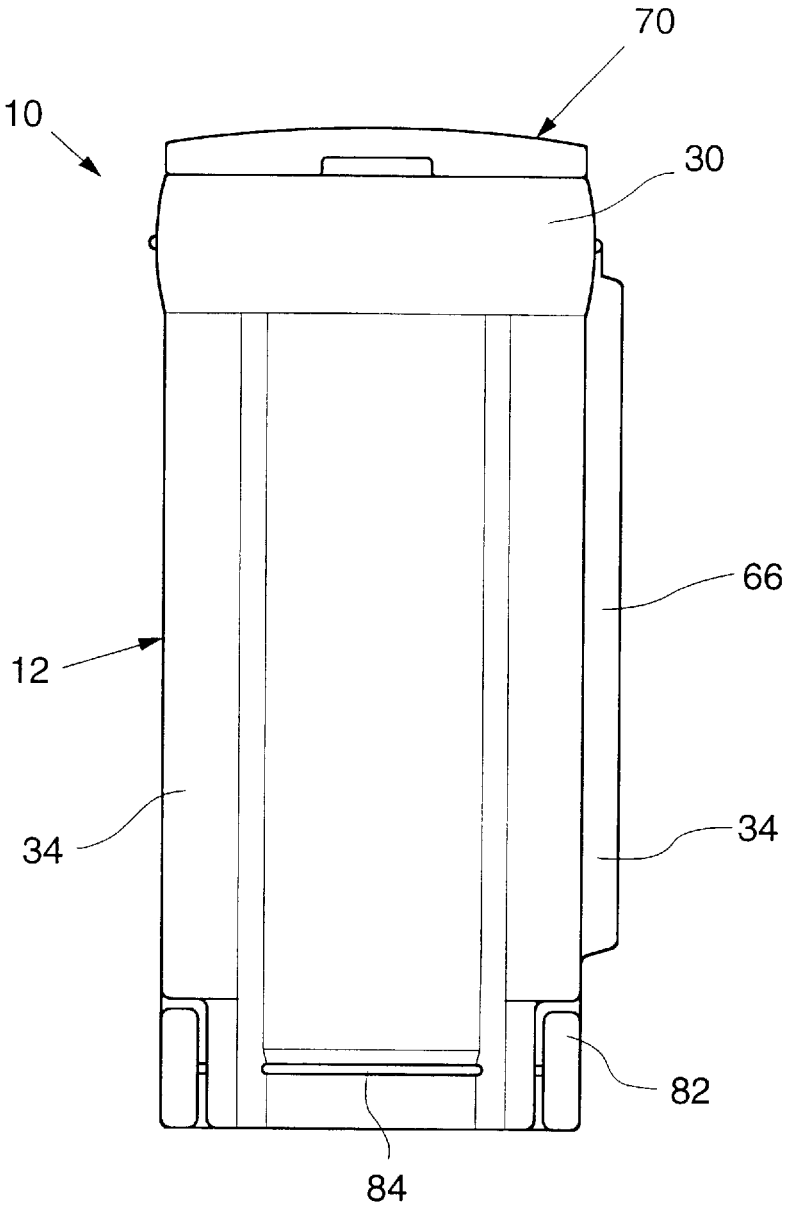
FIG. 4 is a rear elevation view of the portable case.
Figure 5:
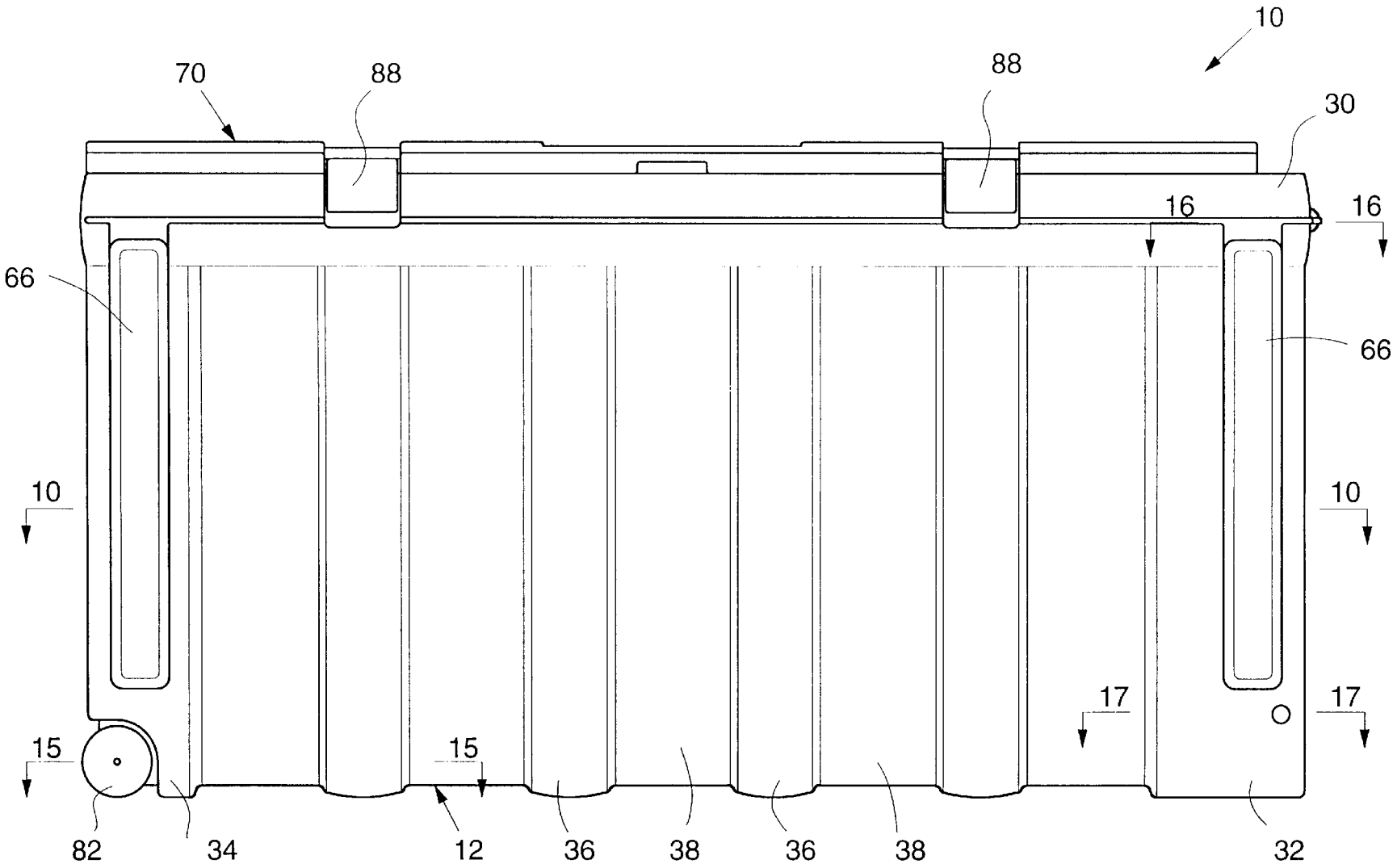
FIG. 5 is a left side elevation view of the portable case.
Figure 6:
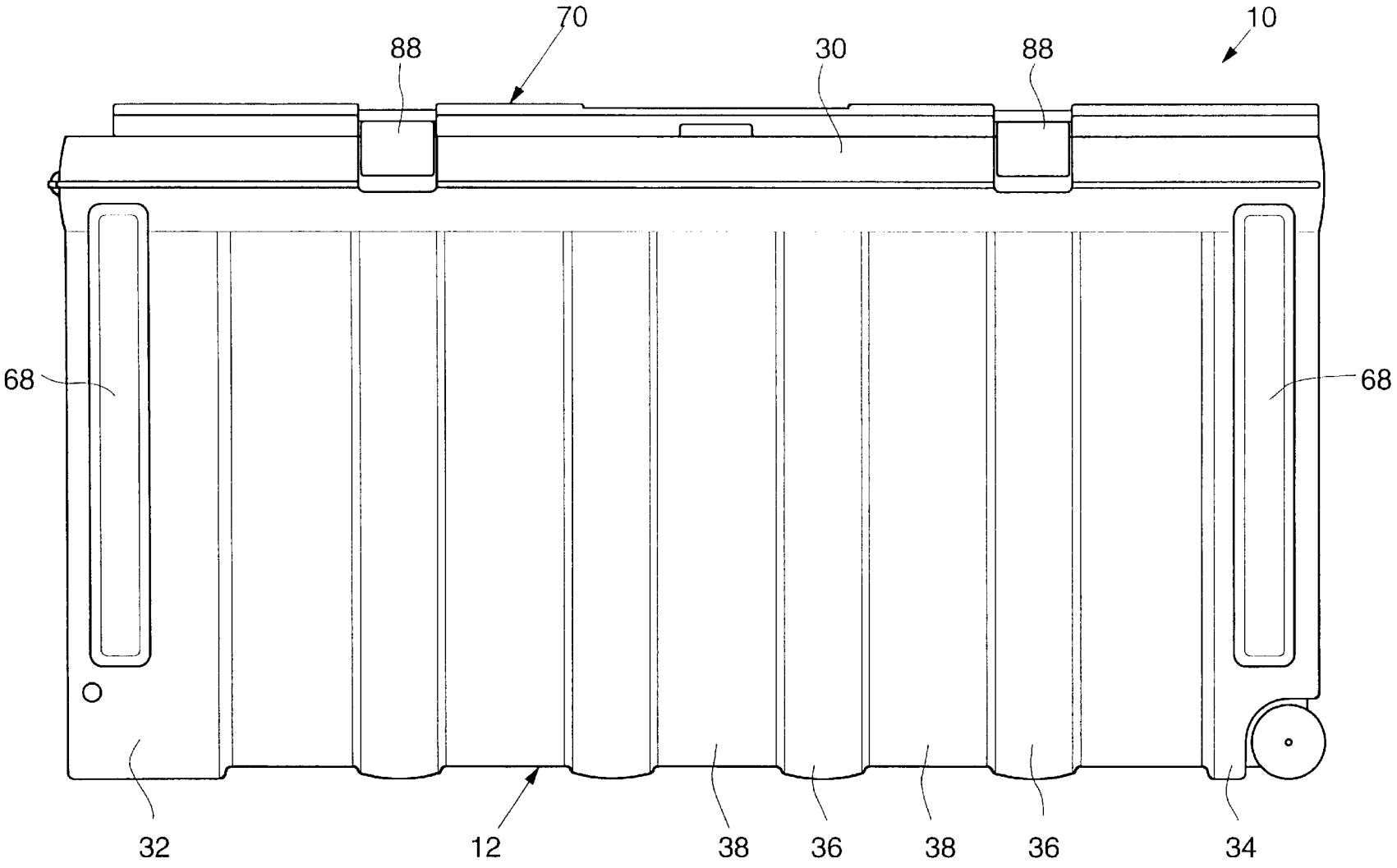
FIG. 6 is a right side elevation view of the portable case.
Figure 7:
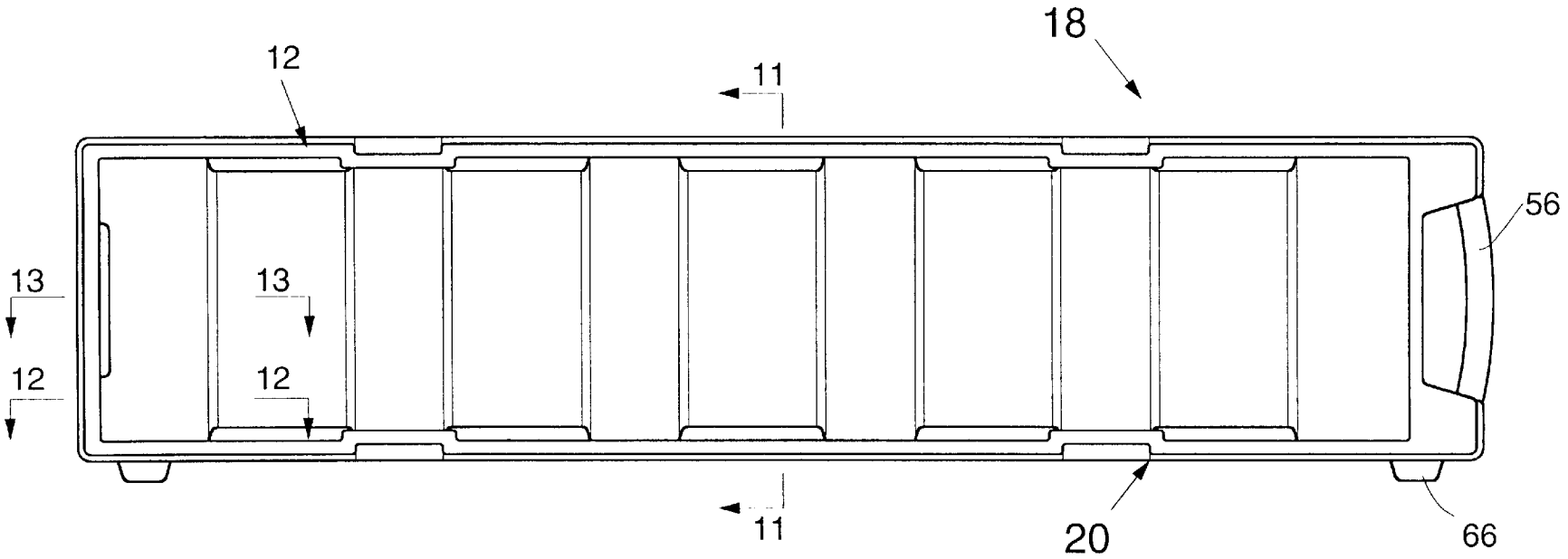
FIG. 7 is a top plan view of the portable case with the lid removed.
Figure 8:
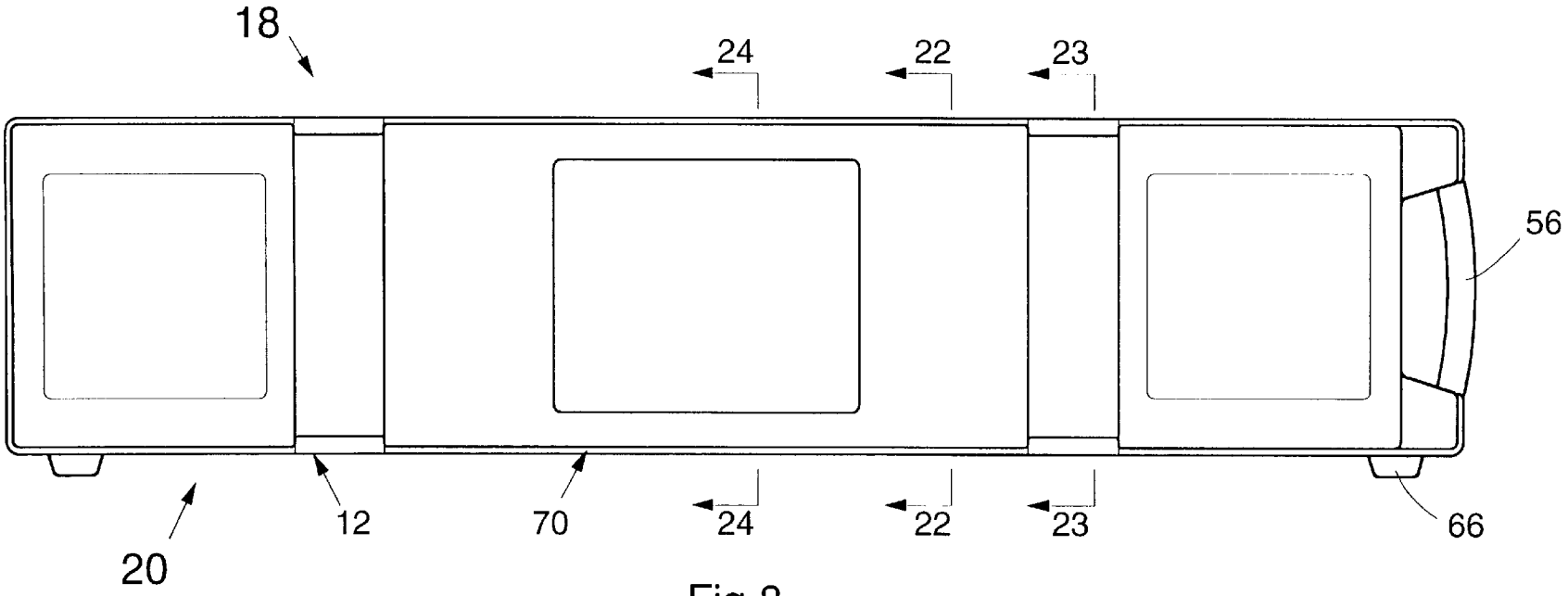
FIG. 8 is a top plan view of the portable case with the lid in place.
Figure 9:
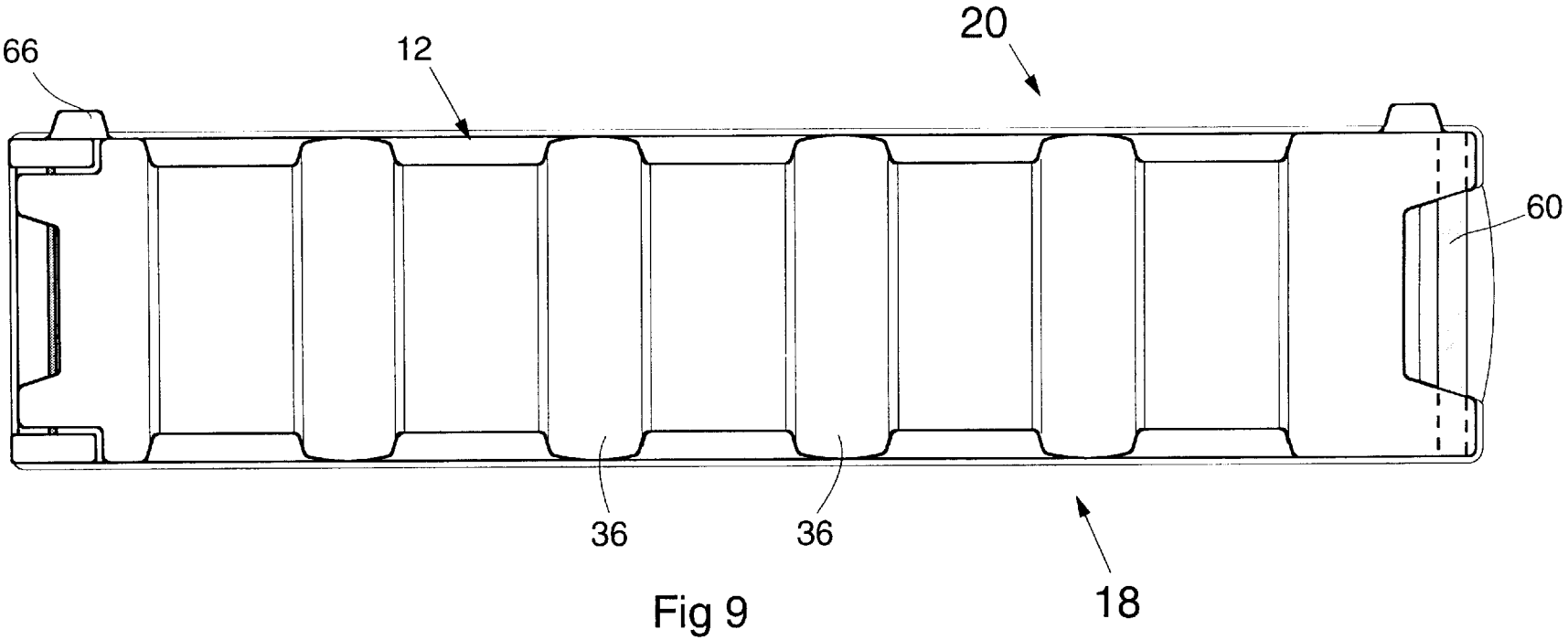
FIG. 9 is a bottom plan view of the portable case.

The container 12 includes a front end (FIG. 3), a rear end (FIG. 4), opposing sides 18 and 20 (FIGS. 5 and 6), a bottom 22 (FIG. 8), and an open top 24 (FIG. 7). The ends 14 and 16, sides 18 and 20, and bottom 22 are integrally formed preferably by a rotational molding process. The container 12 is approximately 26" tall, 52.5" long (i.e., from front to rear), and 12" deep.

Figure 10:
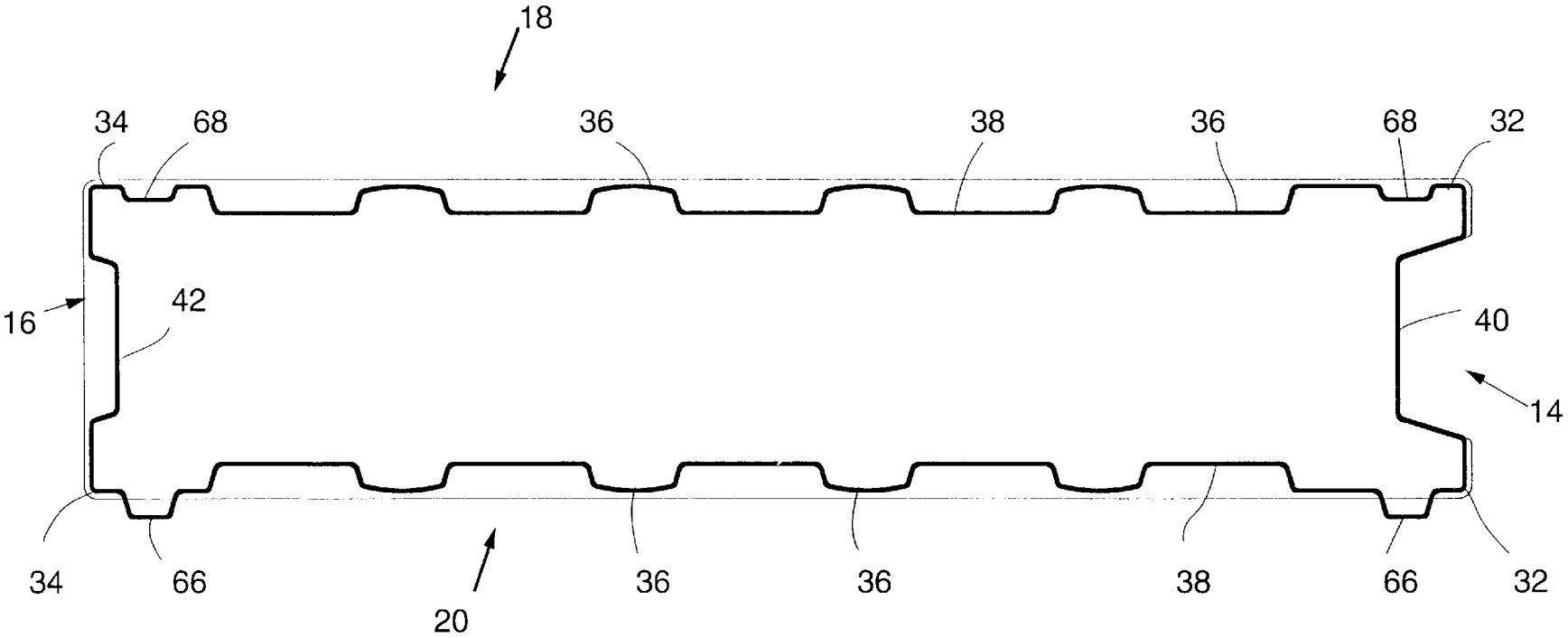
FIG. 10 is a cross-section view of the portable case taken through line 10—10 of FIG. 5.

A rim 30 surrounds the open top 24 of the container 12. Corner posts 32 and 34 extend downwardly from the rim 30 at each corner of the container 12. The front corner posts are identified by reference number 32 and the rear corner posts are identified by reference numeral 34. The sidewalls 18 and 20 of the container 12 include a series of alternating ribs 36 and recessed side panels 38 as shown most clearly in FIG. 10. The front panel 40 and rear panel 42 are also recessed between respective corner posts 32 and 34.

Figure 11:
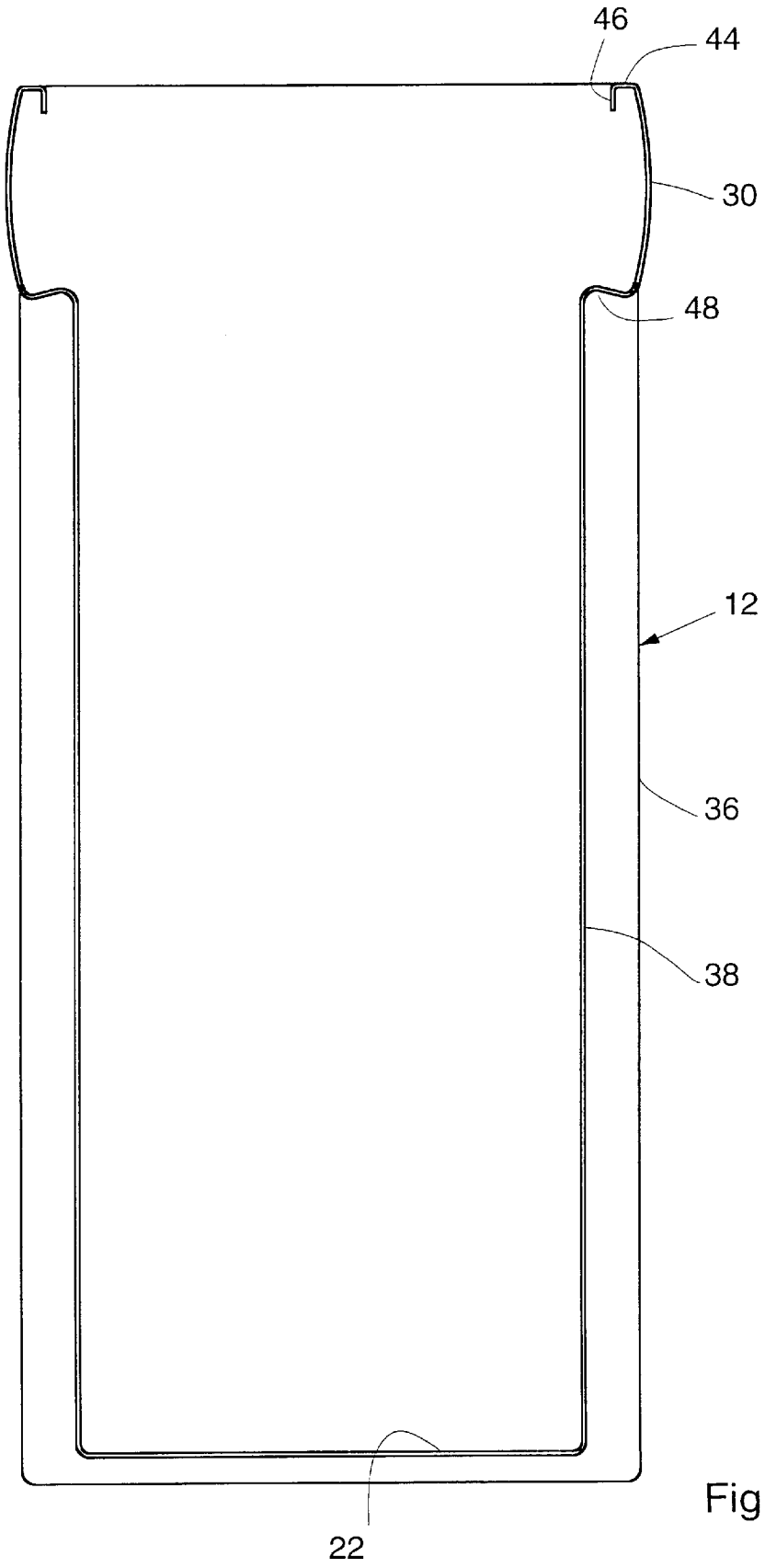
FIG. 11 is a cross-section view of the portable case taken through line 11—11 of FIG. 7.

Referring now to FIG. 11, a cross-section of the container 12 is shown. As seen in FIG. 11, the rim 30 includes a top surface or seating surface 44 on which the lid 70 of the container 12 seats. A flange or lip 46 extends downwardly from the seating surface 44. The purpose of the lip 46 is to frictionally hold the lid 70 of the container 12 in place as will be hereinafter described. Another feature of the rim 30 is that it includes integrally formed hand holds 48 along an underside thereof between the ribs 36 of the container 12. The hand holds 48 are undercut slightly to allow a firm grip to be obtained.

Figure 12:
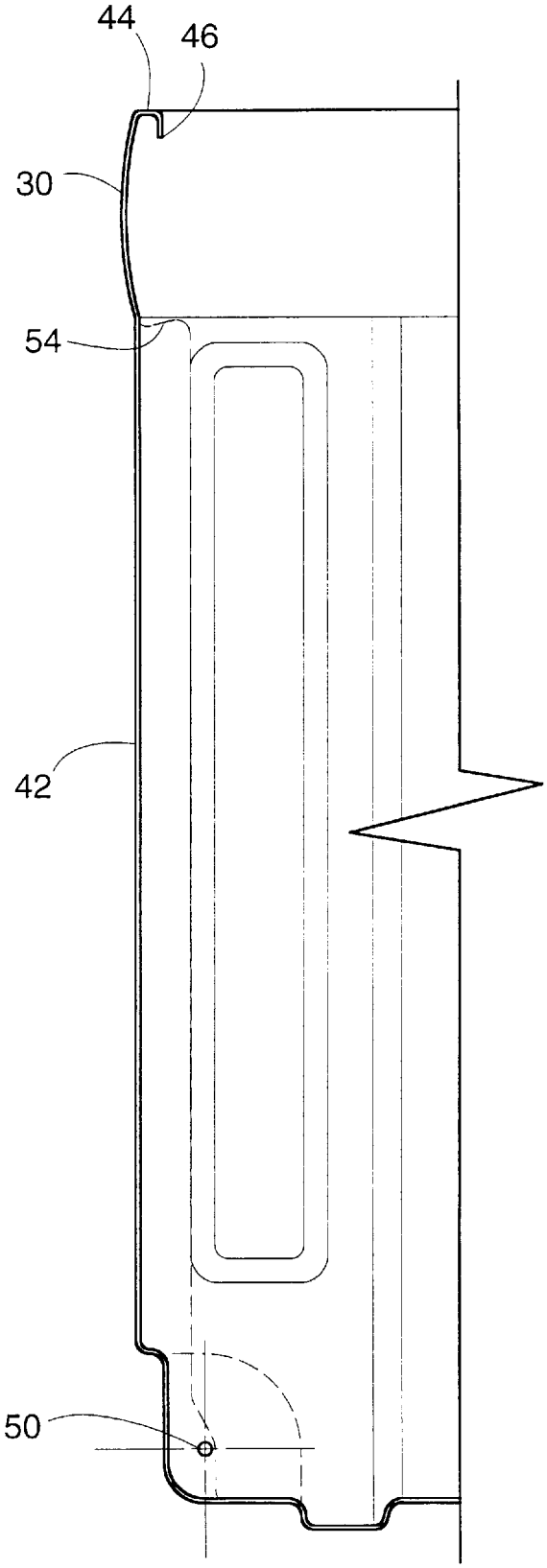
FIG. 12 is a partial section view of the portable case taken through line 12—12 of FIG. 7.
Figure 13:
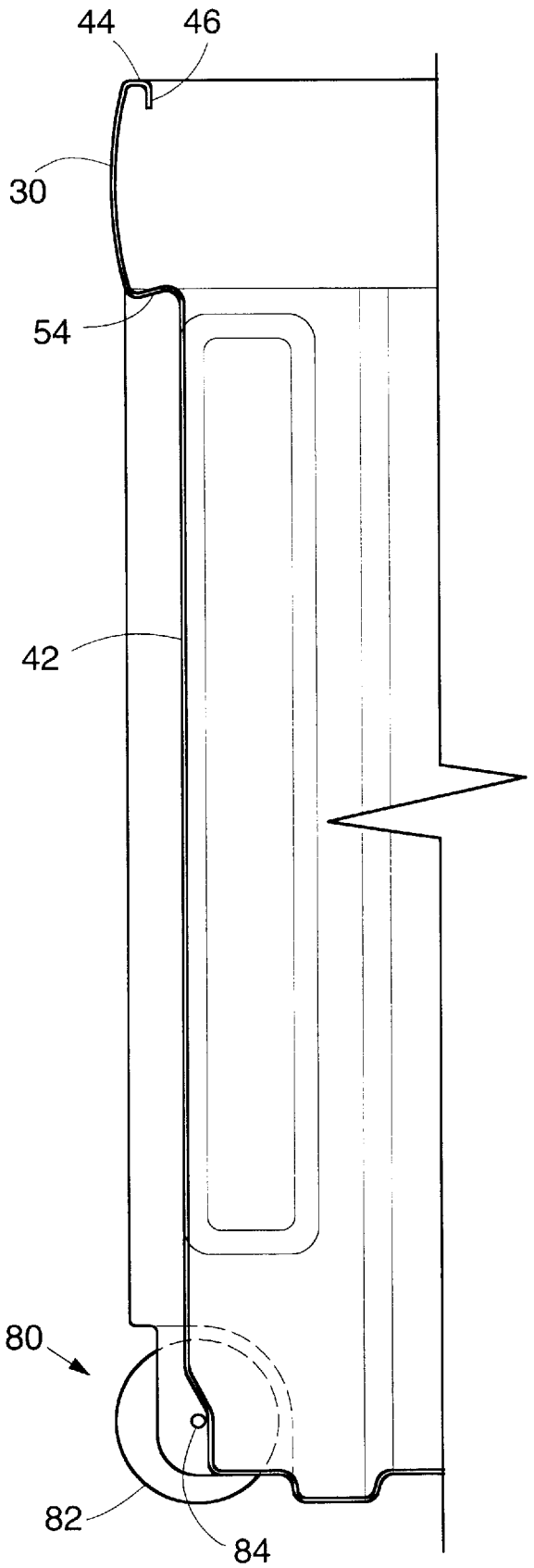
FIG. 13 is a partial section view of the portable case taken through line 13—13 of FIG. 7.
Figure 14:
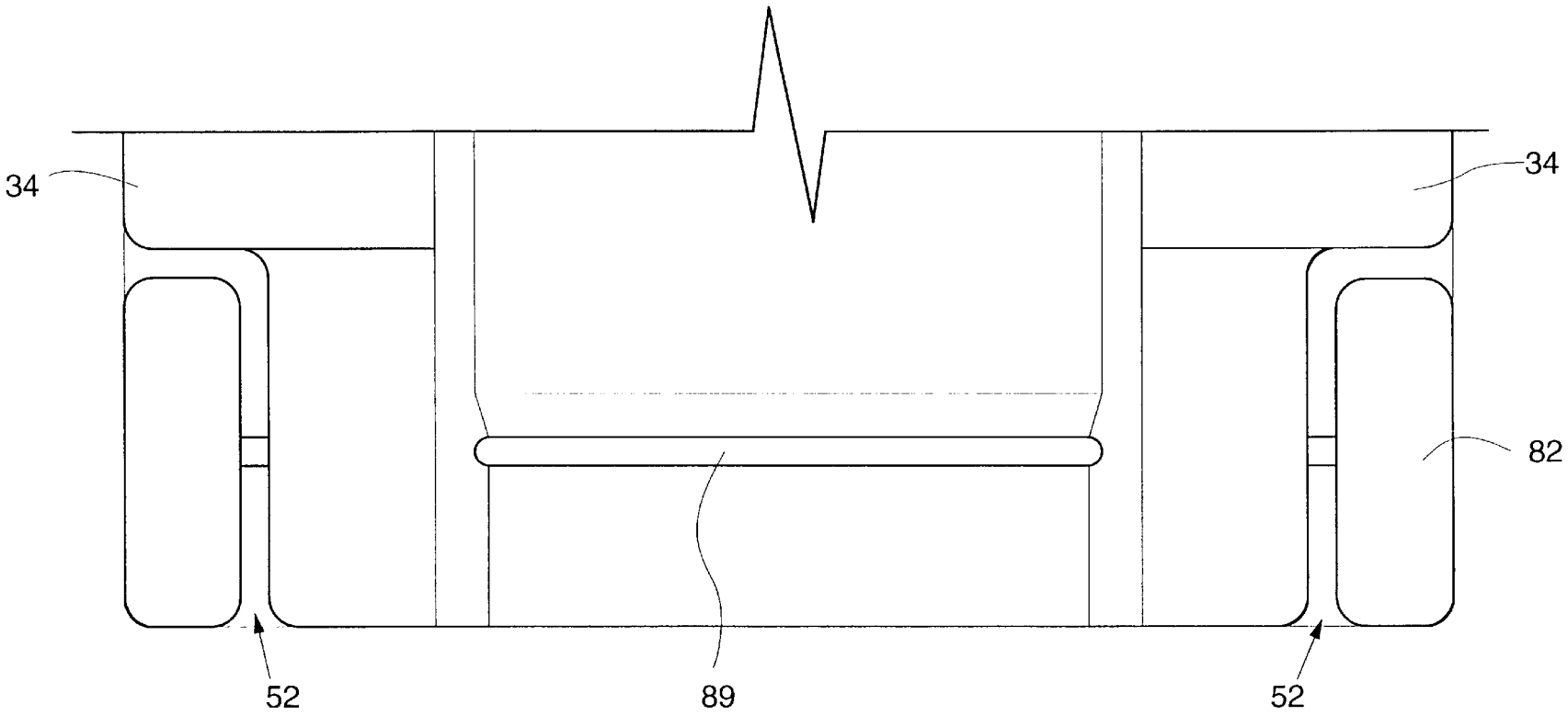
FIG. 14 is a partial elevation view of the portable case from the rear showing the wheel assembly.
Figure 15:
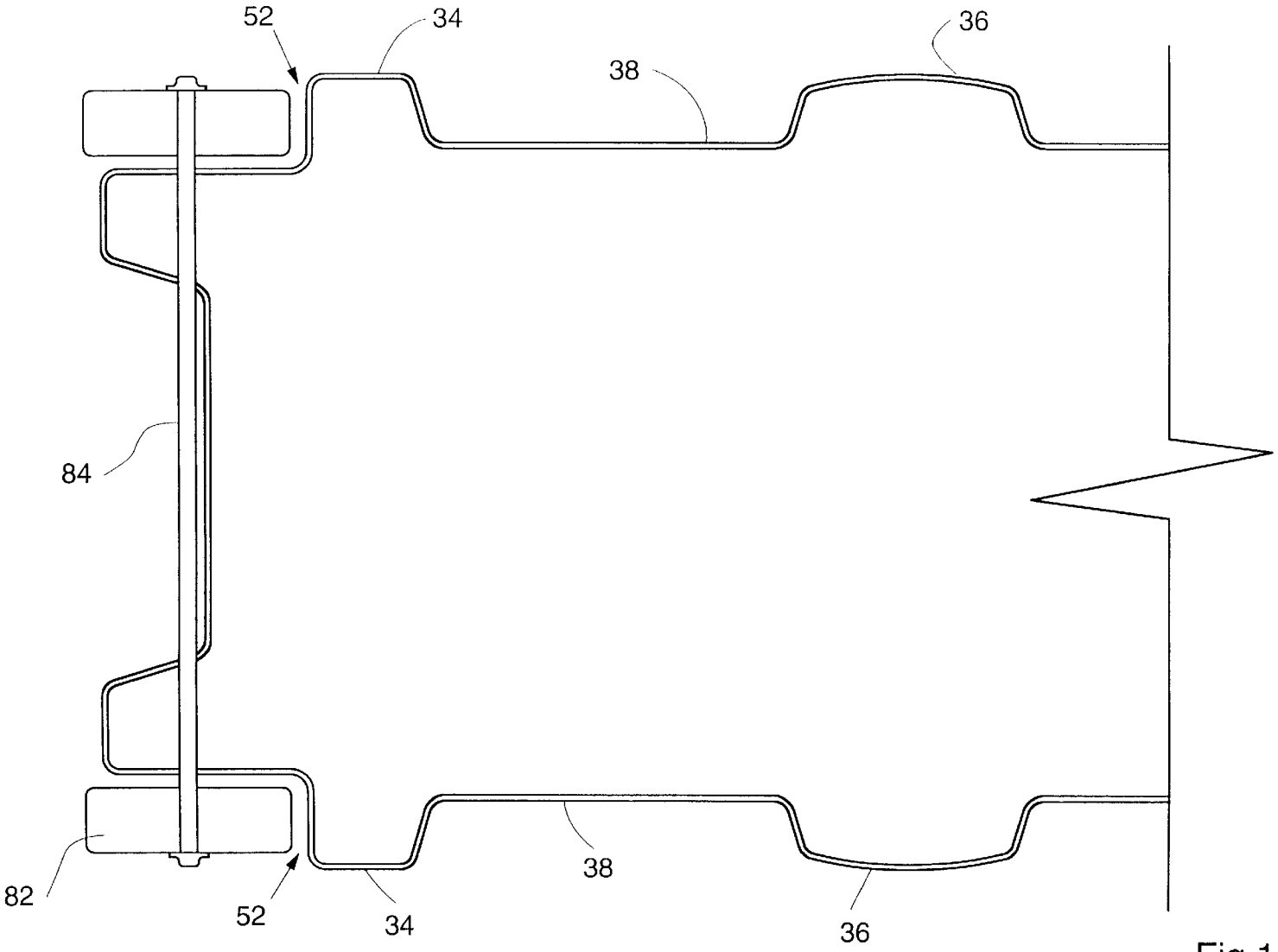
FIG. 15 is a partial section view of the portable case taken through line 15—15 of FIG. 5.

Referring now to FIGS. 12 and 13 of the drawings, partial section views through the rear end 16 of the container 12 are shown. As shown in FIGS. 12 and 13, a wheel assembly 80 is rotatably mounted at the rear end 16 of the container 12 adjacent the bottom 22. The wheel assembly 80 comprises a pair of spaced-apart wheels 82 mounted at opposite ends of an axle 84 as best seen in FIG. 14. In the embodiment shown, the wheels 82 are fixedly secured to the axle 84 which rotates in axle holes 50 in the container 12 (See FIG. 12). To prevent the wheels 82 from protruding beyond the sides of the container 12, wheel recesses 52 are formed at the lower end of each rear corner post 34. It should also be noted that the rear panel 42 steps back at the lower end thereof as seen in FIGS. 13 and 14 so that the majority of the length of the axle 84 lies outside of the interior of the container 12.

Referring back again to FIGS. 12 and 13, it is seen that a rear handle 54 is formed in the rear end 16 of the container 12 adjacent the open top 24 and between the corner posts 34. In the embodiment shown, the rear handle 54 comprises an integrally formed hand hold in the underside of the rim 30 similar to the hand holds 48 along the sidewalls 18 and 20 of the container 12. The rear handle or grip 54 is used for lifting and carrying the container 12.

Figure 16:
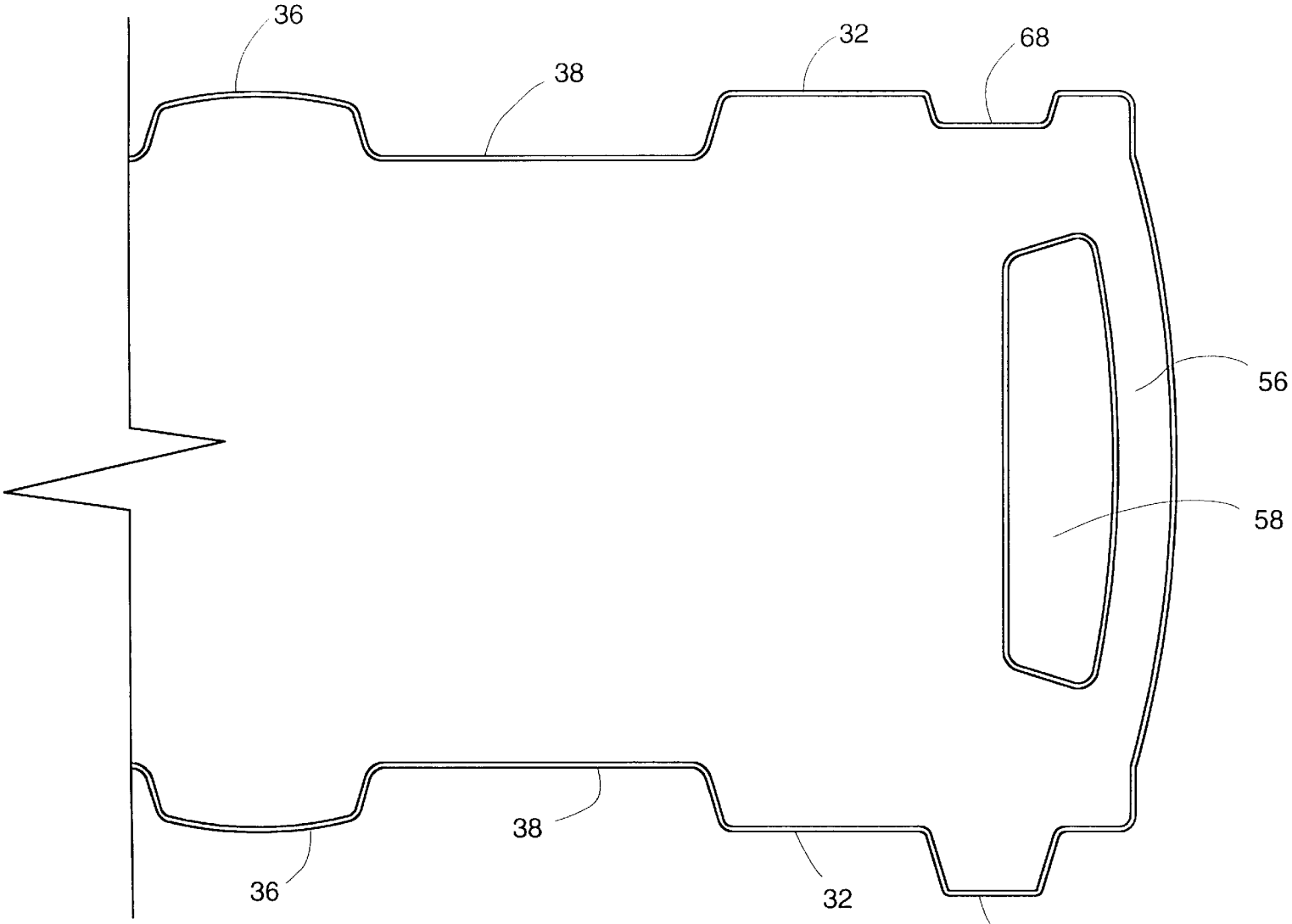
FIG. 16 is a partial section view of the portable case taken through line 16—16 of FIG. 5.

FIG. 16 is a partial section view of the container 12 illustrating the front handle 56. The front handle 56 is an integrally molded tubular piece which extends between the front corner posts 32. A finger hole 58 is formed behind the handle 56 to enable a firm grip to be obtained on the handle 56. The front handle 56 is also used for lifting and carrying the case 10 as will be hereinafter described.

Figure 17:
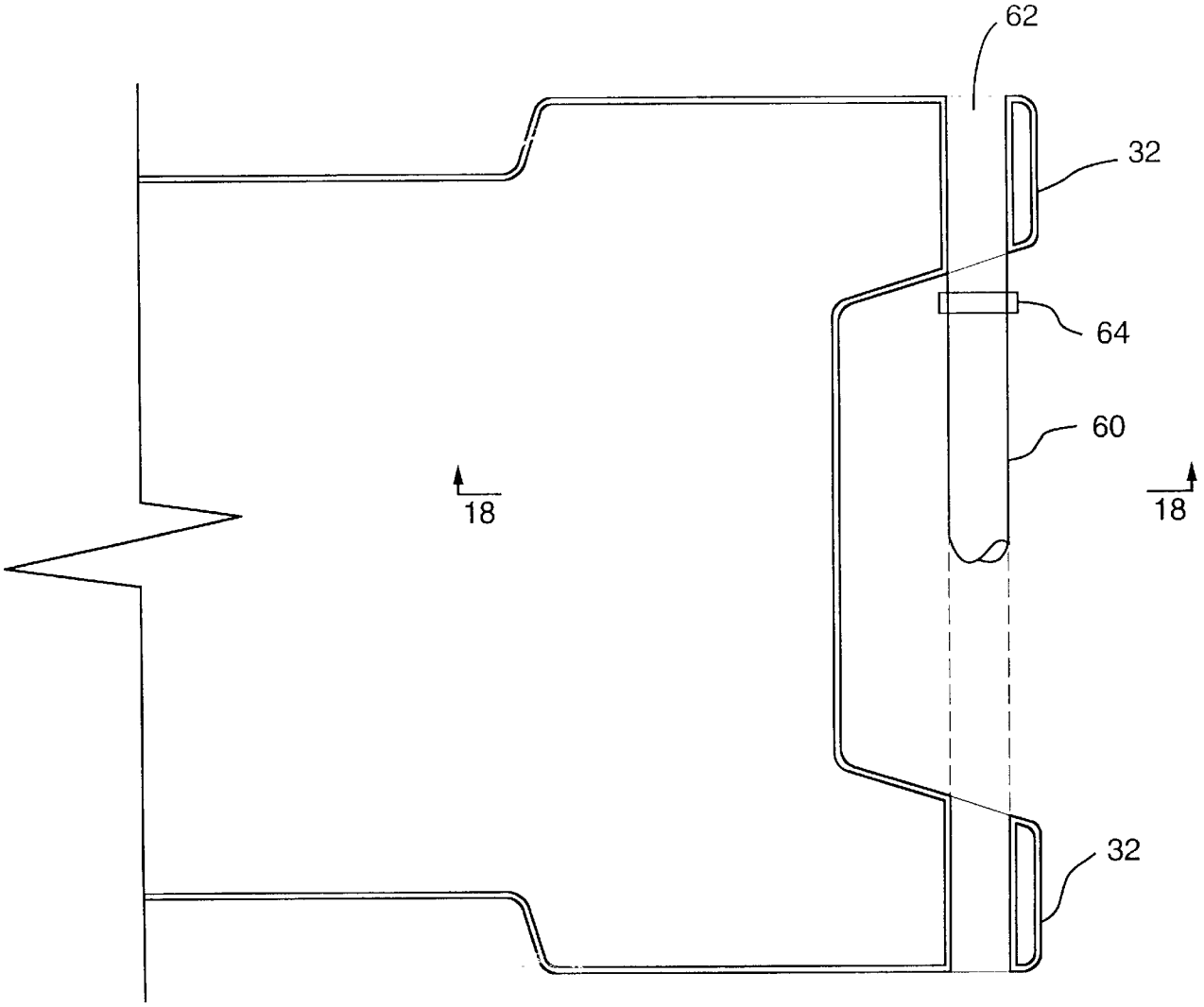
FIG. 17 is a partial section view of the portable case taken through line 17—17 of FIG. 5.
Figure 18:
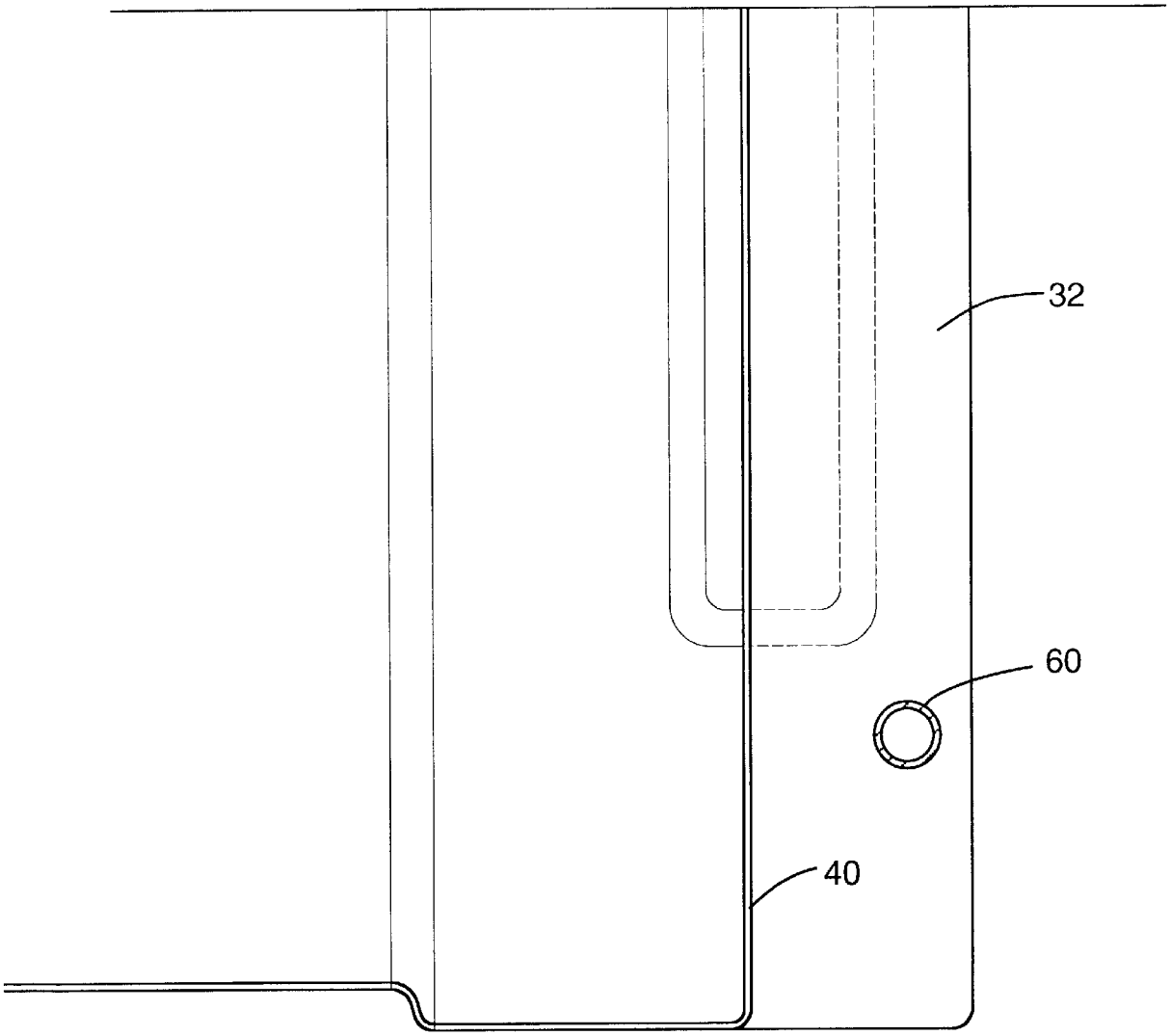
FIG. 18 is a partial section view of the portable case taken through line 18—18 of FIG. 17.
Figure 19:
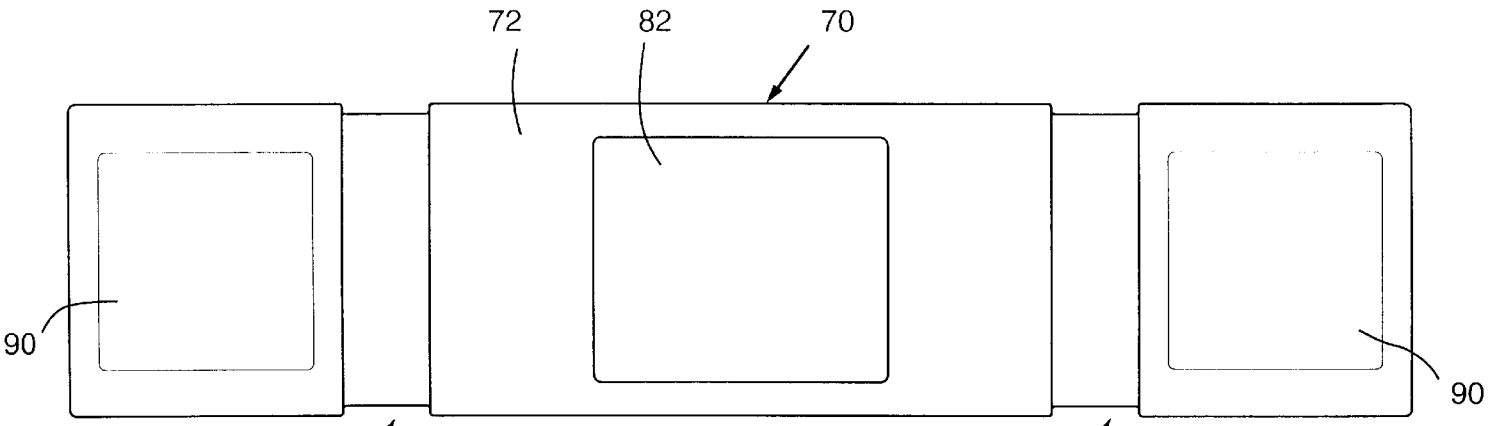
FIG. 19 is a top plan view of the lid of the portable case.
Figure 20:
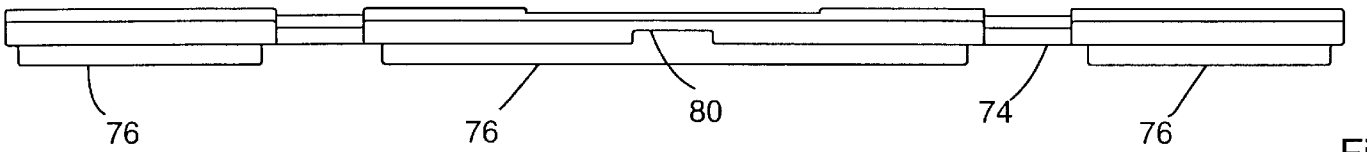
FIG. 20 is a side elevation view of the lid of the portable case.
Figure 21:
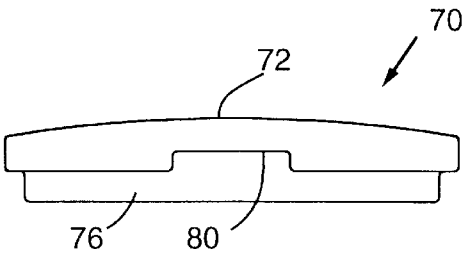
FIG. 21 is an elevation view of the lid of the portable case from the end thereof.
Figure 22:
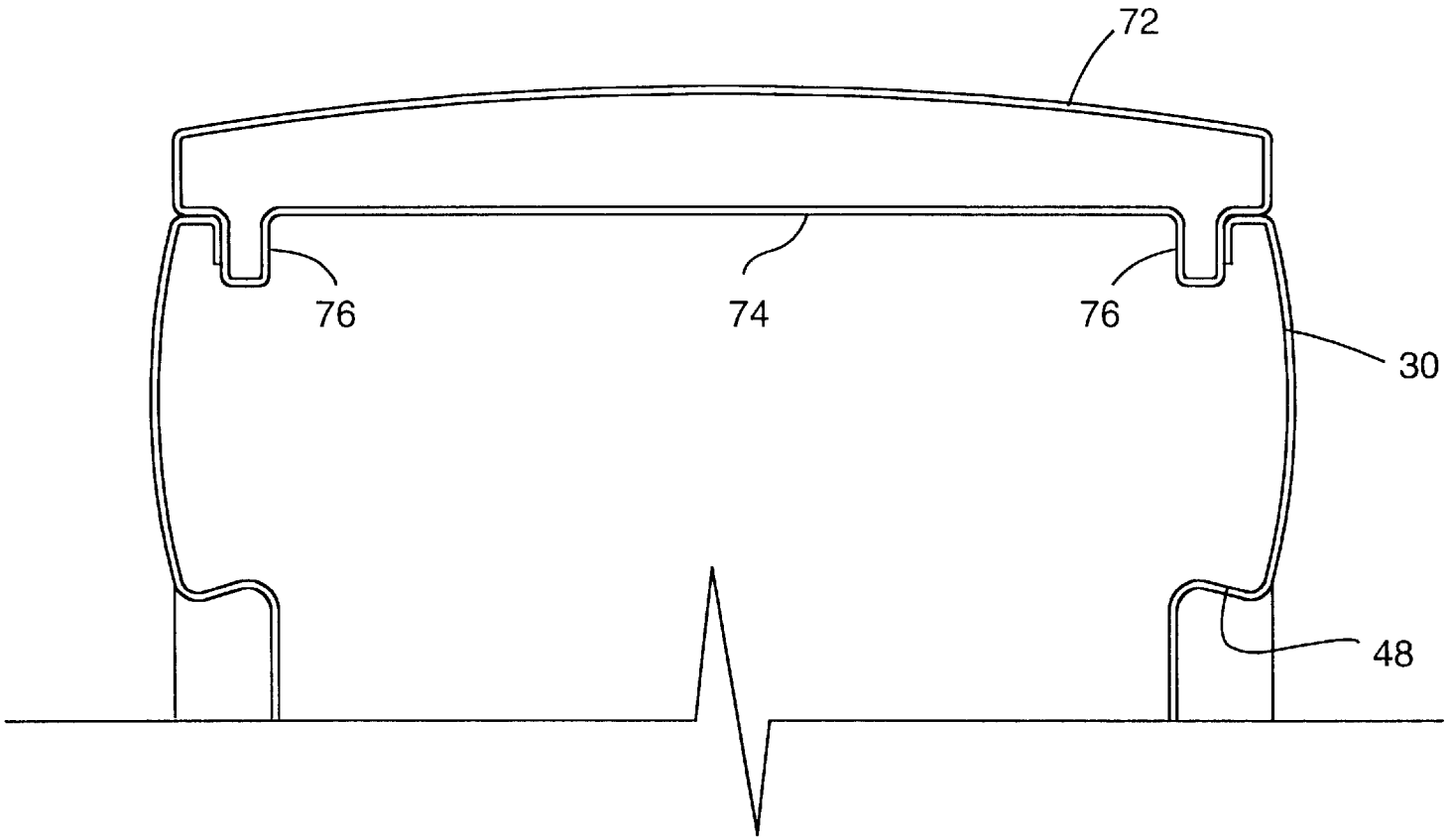
FIG. 22 is a partial section view of the portable case taken through line 22—22 of FIG. 8.
Figure 23:
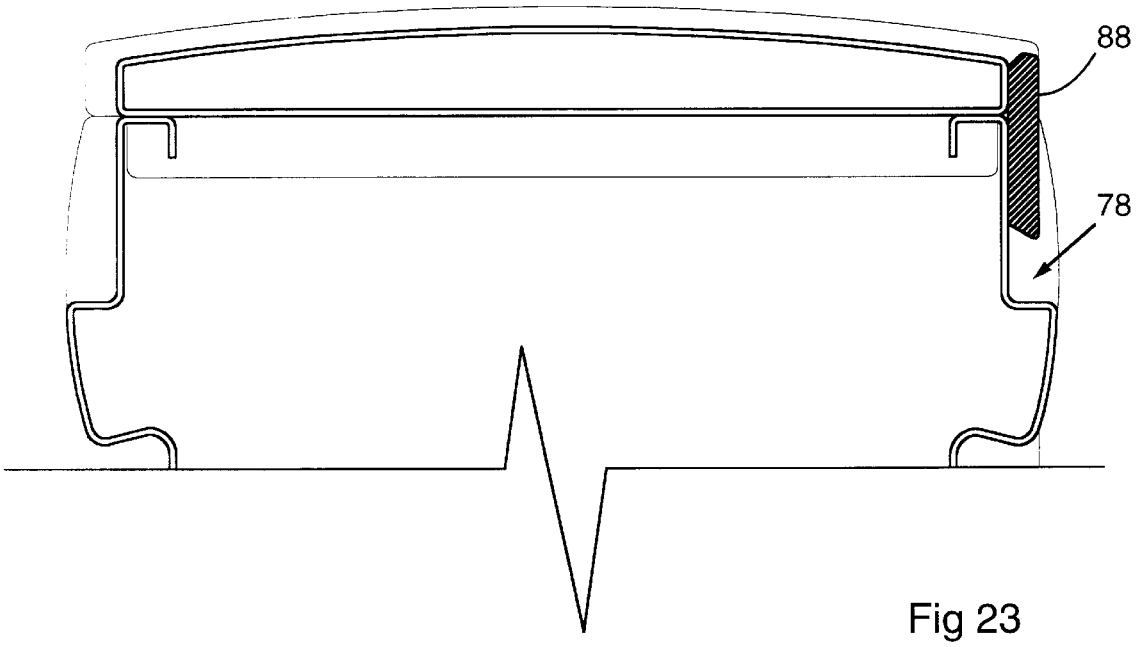
FIG. 23 is a partial section view of the portable case taken through line 23—23 of FIG. 8.
Figure 24:
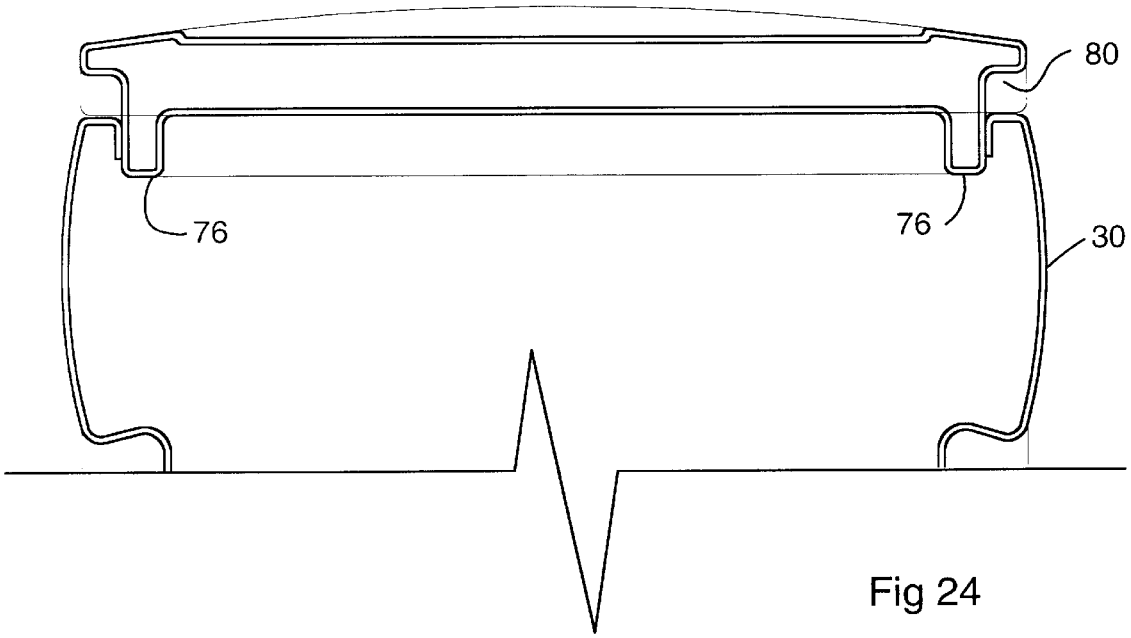
FIG. 24 is a partial section view of the portable case taken through line 24—24 of FIG. 8.

Referring now to FIG. 17, a partial section view of the container 12 is shown. As seen in FIG. 17, a third handle 60 is provided at the front end 14 of the container adjacent the bottom 22. The lower front handle 60 comprises a tubular bar which is journaled at opposite ends in handle openings 62 formed in the front corner posts 32 (See FIG. 18). The handle 60 is secured in place by retaining pins 64 which pass through corresponding openings at each end of the bar 60. The retaining pins 64 prevent the handle 60 from sliding in the axial direction.

The lid 70 of the container 12 is illustrated in more detail in FIGS. 19–24. The lid 70 preferably has a double wall formed by rotational molding. The lid 70 includes a top surface 72 and a bottom surface 74. Locating walls 76 project downwardly from the bottom surface 74 of the lid 70. The function of the locating wall 76 is to locate the lid 70 with respect to the open top 24 of the container 12. When the lid 70 is placed on top of the container 12, the locating wall 76 frictionally engages the flange or lip 46 on the rim 30 of the container 12. To facilitate the removal of the lid 70, a series of finger holes 80 are formed in the sides and ends of the lid 70. The finger holes 80 provide a convenient finger grip for removing the lid 70 from the container.

The lid 70 is preferably secured to the container by means of a buckle 88. The portable case 10 of the present invention is particularly designed to protect the buckle 88 and prevent it from being sheared from the container 12. Protection of the buckle 88 is afforded by locating the buckle in a buckle recess 78. The buckle recess 78 comprises recessed areas in both rim 30 of the container 12 and in the lid 70.

In a preferred embodiment of the invention, a recessed panel 82 is formed in the top surface 72 of the lid 70. The recessed panel 82 has a polished surface for shipping labels and logo inserts.

The case 10 of the present invention is admirably suited for transporting trade show exhibits and materials. The height of the container 12 makes it relatively easy to insert and remove the contents of the container without an excessive amount of bending. In this regard, it is noted that the container normally rests on its bottom 22 during loading and unloading of the container 12. The container 12 can be rotated about the axis of the wheel assembly 80 from its normal loading and unloading position to an upright position in which the container rests on the rear end. This orientation is useful, for example, for storing the case 10 in a compact area such as a closet.

The case 10 of the present invention can be easily handled by either one or two persons. The handles 54 and 56 adjacent the open top at opposing ends of the container 12 allow two persons standing at opposite ends of the container to lift and carry the container 12. The container 12 can also be moved by lifting on either of the front handles 56 and 60 and rolling the container 12 on the wheel assembly 80. Lifting on the upper front handle 56 allows the front end of the container 12 to be lifted a relatively short distance from the ground. This is useful for moving the container 12 short distances. The lower front handle 60 allows the front end 14 of the container to be lifted higher from the ground. In this position, the weight of the container 12 and its contents can be balanced on the wheel assembly 80 making it easy for a single person to move even heavy loads.

In some circumstances, it may be desirable for a single person to move the container 12 by lifting and carrying it for a short distance. In this situation, the person may stand on one side of the container, grab hand holds 48 on opposite sides of the container, and lift up on the container 12.

Another useful feature of the present invention is its ability to stack upon other containers of similar design. The container 12 of the present invention may be laid upon one side for shipment or storage and stacked one upon another. When the containers 12 are stacked, the stacking feet 66 of one container 12 mate with the stacking recesses 68 of an adjacent container 12. The nesting of the stacking feet 66 of one container 12 with the stacking recesses 68 of another container 12 prevents the containers from shifting during shipment or storage.

What is claimed is:

1. A case for transporting articles comprising.

a) a container having a bottom, two opposing sides, two opposing ends, and an open top;

b) corner posts integrally formed with the sides and ends of the container at each corner of the container;

c) a pair of stacking feet projecting outwardly from the corner posts on one side of the container, and a pair of stacking recesses formed in the corner posts on an opposing side of the container, the stacking feet and the stacking recesses being arranged so that the stacking feet fit into the stacking recesses when two or more containers are placed in side-by-side relationship with one another;

d) first and second handles disposed at respective ends adjacent the open top of the container to allow the container to be carried by two persons lifting on the first and second handles; and e) a lid for closing the open top of the container.

2. The case according to claim 1 wherein the case is rotatable about the wheel assembly from a first position in which the bottom of the container rests on a support surface and a second position in which the first end of the container rests on the support surface.

3. The case according to claim 1 wherein said bottom, sides and ends of the container are integrally molded.

4. The case according to claim 1 further including a wheel assembly mounted in a fixed position at a first end of the container adjacent the bottom.

5. The case according to claim 3 wherein the container includes a plurality of integrally molded ribs that extend vertically along the sides of the container, the ribs being spaced from one another along the sides of the container.

6. The case according to claim 4 wherein said wheel assembly is mounted so that the container may rest in a horizontal position with the bottom surface in contact with a horizontal supporting surface.

7. The case according to claim 4 further including a third handle mounted in a fixed position at the second end of the container opposite the wheel assembly and adjacent the bottom of the container to allow the container to be moved by lifting on the third handle so as to place the wheel assembly into rolling contact with the support surface.

8. The case according to claim 5 wherein each rib includes two vertical portions extending along the sides of the container and a horizontal portion extending horizontally along the bottom of said container.

9. The case according to claim 5 further including hand holds formed in the sides of the container adjacent the open top thereof, the hand holds being disposed between the ribs.

10. A case for transporting articles comprising:

a) an integrally molded container including a bottom, two opposing sides, two opposing ends, and an open top;

b) a rim surrounding the open top of the container and integrally formed with the opposing sides and ends of the container;

c) corner posts integrally formed with the sides and ends of the container at each corner of the container; and d) a pair of stacking feet projecting outwardly from the corner posts on one side of the container, and a pair of stacking recesses formed in the corner posts on an opposing side of the container, the stacking feet and the stacking recesses being arranged so that the stacking feet fit into the stacking recesses when two or more containers are placed in side-by-side relationship with one another.

11. The case according to claim 10 further including a wheel assembly mounted to one end of the container adjacent the bottom of the container.

12. The case according to claim 10 further including a plurality of integrally molded ribs spaced along the sides of the container, each of the ribs including two vertical portions that extend along respective sides of the container from the rim to the bottom of the container, and a horizontal portion that extends along the bottom of the container and joins the two vertical portions at the lower ends of the vertical portions.

13. The case according to claim 11 further including a first handle disposed at a first end of the container adjacent the open top, and a second handle disposed at a second end of the container adjacent the open top to allow two persons to carry the container by lifting on the first and second handles.

14. The case according to claim 11 wherein the case is rotatable about the wheel assembly from a first position in which the bottom of the container rests on a support surface and a second position in which the first end of the container rests on the support surface.

15. The case according to claim 12 further including a plurality of handholds formed in the rib of the container between the vertical portions of the ribs.

16. The case according to claim 13 further including a third handle disposed at the second end of the container adjacent the bottom to allow the container to be moved by lifting on the third handle and rolling the container on the wheel assembly.

17. A case for transporting articles comprising:

a) a container having a bottom, two opposing sides, two opposing ends, and an open top;

b) a wheel assembly mounted in a fixed position at a first end of the container adjacent the bottom, said wheel assembly being mounted such that the container may rest in a horizontal position with the bottom surface in contact with a horizontal supporting surface;

c) posts integrally formed with the sides and ends of the container at each corner of the container;

d) a pair of stacking feet projecting outwardly from the corner posts on one side of the container, and a pair of stacking recesses formed in the corner posts on an opposing side of the container, the stacking feet and the stacking recesses being arranged so that the stacking feet fit into the stacking recesses when two or more containers are placed in side-by-side relationship with one another; and e) a lid for closing the open top of the container.

18. The case according to claim 17 further including first and second handles disposed at respective ends adjacent the open top of the container to allow the container to be carried by two persons lifting on the first and second handle.

19. The case according to claim 18 further including a third handle mounted in a fixed position at the second end of the container opposite the wheel assembly and adjacent the bottom of the container to allow the container to be moved by lifting on the third handle so as to place the wheel assembly into rolling contact with the support surface.

* * * * *